United States Patent [19]

Cochran

[11] Patent Number: 4,574,261

[45] Date of Patent: Mar. 4, 1986

[54] BAKEABLE ELECTROMAGNETS

[75] Inventor: Ronald R. Cochran, Mountain View, Calif.

[73] Assignee: Varian Associates, Inc., Palo Alto, Calif.

[21] Appl. No.: 768,884

[22] Filed: Aug. 23, 1985

[51] Int. Cl.[4] ..... H01F 5/00

[52] U.S. Cl. ..... 335/299; 335/210; 335/213; 335/300

[58] Field of Search ..... 335/210, 282, 296, 299, 335/300, 213; 336/179, 206

[56] References Cited

U.S. PATENT DOCUMENTS 1,972,319 9/1934 Rypinski ..... 335/282 X 2,853,657 9/1958 Hofacker ..... 335/300

3,056,071 9/1962 Baker et al. ..... 335/300

4,388,568 6/1983 Goseberg et al. ..... 335/213 X

*Primary Examiner*—George Harris

*Attorney, Agent, or Firm*—Stanley Z. Cole; Kenneth L. Warsh

[57] ABSTRACT

A bakeable electromagnet assembly is made of coils of metal foil either anodized to insulate between turns or separated by a film of Kapton. Cooling plates connected to a source of cooling fluid are used to remove heat. Heat is conducted from the coils to the cooling plates by a powder which is a heat conductor and electrical insulator such as boron nitride. An external shell made of high magnetic permeability material provides a return path for the magnetic field.

8 Claims, 1 Drawing Figure

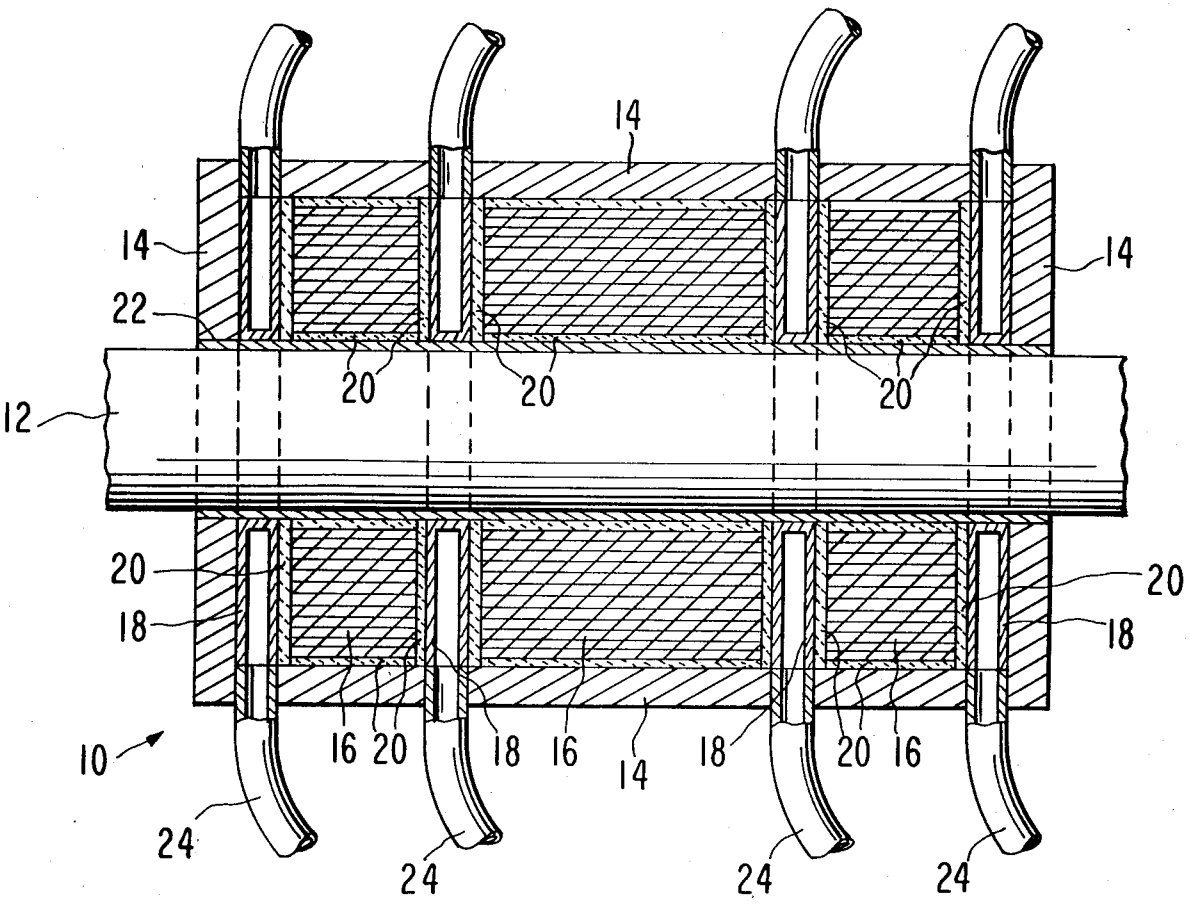
14
20
18
24
16
20
24
18
14
14
16
20
18
24
20
20
16
24
14
22
20
18
10
12

BAKEABLE ELECTROMAGNETS

FIELD OF THE INVENTION

This invention pertains to a new structure of electromagnet which is bakeable, more particularly to an electromagnet which can be formed on an electron beam tube before bakeout of the tube.

BACKGROUND OF THE INVENTION

Klystrons and other electron beam devices requiring a magnetic field for their operation could be made smaller and lighter if the electromagnet could survive the high temperature bakeout required during the fabrication of the device. There are many high temperature electrical devices, for example, electrical heating elements using ceramic or mica insulation. The requirements for a bakeable electromagnet are different from a heating element, however, in that the conductor in an electromagnet needs to be kept as cool as possible during operation.

The approach to forming an electromagnet on an electron beam tube can be divided into a "wrapped solenoid" approach and a "wound-on magnet" approach. In the "wrapped solenoid" approach, the tube is assembled and baked and then a solenoid is wrapped on the tube using the tube as a spool. In the "wound-on magnet" approach, the electromagnet is a component to be assembled with other components to make a complete tube and then baked.

The "wound-on magnet" design has several serious disadvantages. It is presumed that the tube is tested first in an ordinary solenoid magnet to assure meeting all electrical specifications. Then the device, now representing a substantial monetary investment, is mounted in a winding fixture for application of the magnet turns. The magnet winding operation may or may not be successful. In either case, further testing must be carried out. If the magnet does not yield the desired results, then it must be unwound and a second attempt made. The technique offers no change to check the magnet before it is used. Another disadvantage rests in the fact that cutouts, such as those used for passage of the output waveguide, are not possible. Still further, a special system of cooling might be required to remove coil heat. One system that has been successful with low power linear beam tubes make use of coil circulated in contact with the coils. A separate oil-water heat exchanger is employed.

The "bakeable" magnet calls for the use of certain materials that differ from those used in conventional solenoids. The coil winding insulation must withstand the bakeout temperatures. Metal oxides have been used in some attempts in the past, though the history of such units suggest trouble from turn-to-turn shorts.

OBJECT OF THE INVENTION

It is the object of the invention to describe a structure for an electromagnet which will remain operable after high-temperature bakeout.

SUMMARY OF THE INVENTION

Coils of metal foil insulated by Kapton film generate the magnetic field. Cooling plates of copper are used to remove heat from the coil in operation. A heat conducting but electrically insulating powder or fused ceramic such as boron nitride is used to conduct heat from the coils to the cooling plates. An external shell of high magnetic permeability material is used to provide a return path for the magnetic field.

These and further constructional and operational characteristics of the invention will be more evident from the detailed description given hereinafter with reference to the accompanying drawing which illustrates one preferred embodiment by way of non-limiting example.

BRIEF DESCRIPTION OF THE DRAWING

The FIGURE is a section view of the bakeable electromagnet according to the invention.

DESCRIPTION OF THE PREFERRED EMBODIMENT

Referring now to the FIGURE wherein reference numerals are used to designate parts through, there is shown a cross-section of a bakeable electromagnet 10 according to the invention. The electron beam tube 12 is shown schematically at the center of the electromagnet 10. An external shell 14, usually of material of high magnetic permeability to provide a return path for the magnetic field, is shown around the electromagnet. The shell 14 must be sealed by a method which will withstand the bakeout temperature. Coils 16 made from a foil, usually aluminum or copper, generate the magnet field. The conductor layers of the coils 16 are individually insulated from each other by high temperature epoxy bonded Kapton film. Kapton is a polyimide material made by the E. I. DuPont de Nemours Company. The epoxy may carbonize during bakeout, but the Kapton will survive and the layers will be insulated. In the alternative, the insulation can be provided by anodizing the surface of the foil. Copper or aluminum cooling plates 18 containing passages for coolant flow are used to remove heat from the coils during normal operation. The coolant can be water, oil or any other. The coolant passages would be dry during bakeout, probably purged with an inert gas or hydrogen to prevent oxidation. An electrical insulation layer 20 which is thermally conductive is located between each cooling plate 18 and each coil 16. The layer 20 can be a powder with a film of Kapton or a fused layer of ceramic which can be tested before incorporation into the magnet. Aluminum oxide (Alumina) is not an outstanding thermal conductor, but lends itself well to coating the cooling plates. Beryllium oxide (Beryllia) would be ideal, were it not for its toxicity, since it is an excellent electrical insulator and has the highest thermal conductivity of all the ceramics. Boron nitride is the preferred material since it is a good insulator and the packed powder has very good thermal conduction. It can be applied to cooling plates not only by thermal spraying, but by painting and baking as well. A liner 22, preferably of stainless steel, is used between the electromagnet coils 16 and the tube 12. The layer 20 can extend between the liner 22 and the coil 16 and between the coil 16 and the external shell 14 to fill in the voids provide electrical insulation and conduct heat as necessary. The connections 24 between the cooling plates 18 and the cooling source can all be external, as shown in the FIGURE. In the alternative, some internal connections can be used to reduce the number of external connections.

This invention is not limited to the preferred embodiment heretofore described, to which variations and improvements may be made including mechanically and electrically equivalent modifications to component parts, without departing from the scope of protection of the present patent and true spirit of the invention, the characteristics of which are summarized in the following claims.

What is claimed is:

1. A bakeable electromagnet assembly comprising:

a coil of metal foil suitable for baking at 500° C. successive layers of said metal foil being insulated by Kapton film, at least two cooling plates of high thermal conductivity material suitable for baking at 500° C. adapted to be connected to a source of cooling fluid, an external shell of material suitable for baking at 500° C., a linear of material suitable for baking at 500° C., said coil and cooling plates being contained within said external shell and said liner, and a powder of high thermal conductivity and low electrical conductivity between said cooling plates and said coil and filling any void within the assembly whereby to insulate said coil and conduct heat away from said coil.

2. A bakeable electromagnet assembly as in claim 1 wherein said metal foil comprises aluminum.

3. A bakeable electromagnet assembly as in claim 1 wherein said metal foil comprises copper.

4. A bakeable electromagnet assembly as in claim 1 wherein said powder comprises boron nitride.

5. A bakeable electromagnet assembly as in claim 1 wherein said cooling plates comprise copper.

6. A bakeable electromagnet assembly comprising:

a coil of metal foil of aluminum, successive layers of said metal foil being insulated by anodization of the surface of said foil, at least two cooling plates of material chosen from the group of copper and aluminum, said plates being adapted to be connected to a source of cooling fluid, an external shell of material suitable for baking at 500° C., a liner of material suitable for baking at 500° C., said coil and cooling plates being contained within said external shell and said liner, and a powder of high thermal conductivity and low electrical conductivity material suitable for baking at 500° C. between said cooling plates and said coil and filling any void within the assembly whereby to insulate said coil and conduct heat away from said coil.

7. A bakeable electromagnet assembly as in claim 6 wherein said powder comprises boron nitride.

8. A bakeable electromagnet assembly as in claim 1 or 6 in which said external shell comprises material of high magnetic permeability.

* * * * *